United States Patent [19]

Greeson et al.

[11] Patent Number: 4,511,614

[45] Date of Patent: Apr. 16, 1985

[54] SUBSTRATE HAVING HIGH ABSORPTANCE AND EMITTANCE BLACK ELECTROLESS NICKEL COATING AND A PROCESS FOR PRODUCING THE SAME

[75] Inventors: Richard L. Greeson, Longmont; George I. Geikas, Boulder, both of Colo.

[73] Assignee: Ball Corporation, Muncie, Ind.

[21] Appl. No.: 546,780

[22] Filed: Oct. 31, 1983

[51] Int. Cl.[3] ..... B32B 3/26; B05D 5/06; C23C 1/10; C23F 5/02

[52] U.S. Cl. ..... 428/141; 148/6.14 R; 156/625; 156/665; 427/162; 427/307; 427/309; 427/404; 427/405; 428/409; 428/457; 428/688; 428/699

[58] Field of Search ..... 428/141, 457, 409, 688, 428/699; 156/632, 625, 665; 148/6.14 R; 427/162, 307, 309, 404, 405

[56] References Cited

U.S. PATENT DOCUMENTS

| | | | |
|---|---|---|---|
| 3,867,207 | 2/1975 | Decker et al. | 148/6.14 R |
| 4,233,107 | 11/1980 | Johnson | 156/632 |
| 4,361,630 | 11/1982 | Johnson | 428/141 |

*Primary Examiner*—Thomas J. Herbert
*Attorney, Agent, or Firm*—Gilbert E. Alberding

[57] ABSTRACT

A substrate having high absorptance and emittance is produced by roughening the surface of the substrate, immersing the substrate in a first electroless plating bath having a low phosphorus to nickel concentration, then immersing the substrate in a second electroless plating bath having a phosphorus to nickel concentration higher than that of said first electroless plating bath. Thereafter, the resulting electroless nickel-phosphorus alloy coated substrate is immersed in an aqueous acidic etchant bath containing sulfuric acid, nitric acid and divalent nickel to develop a highly blackened surface on said substrate.

19 Claims, 4 Drawing Figures

A. PRIOR ART (X 650)

B. SUBJECT INVENTION (X 650)

SUBSTRATE HAVING HIGH ABSORPTANCE AND EMITTANCE BLACK ELECTROLESS NICKEL COATING AND A PROCESS FOR PRODUCING THE SAME

The present invention relates to a process for producing an optically black coating having high absorptivity and emissivity values utilizing an electroless nickel plating process, and to a substrate provided with said black coating.

BACKGROUND OF THE INVENTION

Prior art methods for producing a black surface coating involve such procedures as depositing on the substrate a coating of black paint, a coating of black surface oxides or metallic compounds, a black coating of metal alloys, or a black coating of mixed metals.

A number of prior methods have been used to blacken areas to produce what is referred to as "optical black" surfaces. In the early work of Decker described in U.S. Pat. No. 3,867,207 he describes a process of blackening a component by using an electroless plating bath selected from the group consisting of nickel and cobalt and after subsequent rinsing immersing in an oxidizing acid bath of phosphoric, sulfuric and nitric acids and thereafter firing the component to form the blackened surface. More recently a process for producing black surface coatings has been described in U.S. Pat. No. 4,233,107 as well as U.S. Pat. No. 4,361,630 to Johnson, Sr., which involves preparing a substrate by cleaning and/or activating it and immersing the thus prepared substrate in an electroless plating bath containing nickel and hypophosphite ions in solution until an electroless nickel-phosphorus alloy coating has been deposited on the substrate. Thereafter, the substrate, coated with the electroless nickel-phosphorus alloy which has been washed and dried, is immersed in in an etchant bath consisting of an aqueous solution of nitric acid, wherein the nitric acid concentration ranges from a 1:5 a ratio with distilled or deionized water to concentrated until the coated surface of the substrate develops ultra-blackness.

While the process described in the aforementioned Johnson, Sr., patent provides a highly blackened surface on a substrate, it has been found that the emissivity capabilities thereof are limited such that its primary use is as a solar collector in the field of solar energy. In contradistinction, the present invention is not so limited in that substrates produced in accordance with the present invention have a highly blackened surface characterized by high infrared emissivities, as well as high absorptive capabilities, thus making them extremely suitable for use in such devices as infrared telescopes and sensors.

SUMMARY OF THE INVENTION

The process of the present invention is applicable to a wide variety of substrates, both metallic and non-metallic so as to produce thereon a highly blackened surface having high radiant energy absorption and high emissivity capabilities. The process comprises, generally, surface-conditioning the substrate so as to provide a roughened, non-smooth surface; immersing the thus surface-roughened substrate in a first electroless plating bath having a low phosphorus to nickel concentration so as to produce a first electroless nickel-phosphorus alloy coating on said surface-roughened substrate; immersing the resulting coated substrate in a second electroless plating bath having a phosphorus to nickel concentration higher than that of said first electroless plating bath so as to produce a second electroless nickel-phosphorus alloy coating which is superimposed on said first electroless nickel-phosphorus alloy coating; immersing the thus dual electroless nickel-phosphorus alloy coated substrate into an acidic etchant bath containing about 0.1 to about 0.001 weight percent divalent nickel for a time sufficient to develop a highly blackened surface; and drying the resulting substrate having said highly blackened surface.

In general, by the expression low phosphorus to nickel concentration as used for the first or initial coating is meant that the coating has a phosphorus content of about 4 to about 5 weight percent and the remainder being substantially nickel based on the total weight of the deposited coating. Further, by the expression high concentration of phosphorus to nickel as used for the second or uppermost coating is meant that the phosphorus content is about 7 to about 9 weight percent of the coating and the remainder is substantially nickel.

Due to an improved morphology over that taught in the Johnson patents, the subject invention provides an article having good performance over a wide range of wavelengths, especially in the infrared. Whereas the Johnson blackened article is one having microscopic pores that of the subject invention provide an article with both microscopic and macroscopic pores. It has been observed that whereas the Johnson blackened article shows a low spectral reflectance of less than 1% at wavelengths of light of about from 0.3 microns to 2.14 microns, the subject invention shows a range of spectral reflectance in the order of from about 1% to about 2% over a much greater range, some ten times more, viz., from 0.3 microns to 25 microns. A blackened substrate of the subject invention comprises a substrate coated with at least two different nickel-phosphorous alloys, said substrate having a dense array of microscopic as well as macroscopic pores etched into the surface, said surface having a spectral reflectance of less than about 5 percent at wavelengths of radiant energy from about 0.3 to 40 microns.

By the expression "macroscopic pores" is meant generally those pore sizes that may be readily seen or resolved between about 1× to 10× magnification and generally are greater than 7 microns in size whereas by the expression "microscopic pores" is meant those pores that may be readily seen or resolved under about 10× magnification or greater and generally have a size of about 7 microns or less.

It should be mentioned that the main function of the macroscopic pores is to capture or entrap radiant energy of essentially long wavelengths, i.e., greater than 10 microns and above. The function of the microscopic pores is to substantially capture or entrap radiant energy of short to intermediate wavelengths, viz., greater than 10 microns and less.

DETAILED DESCRIPTION OF THE INVENTION

Figure 1:
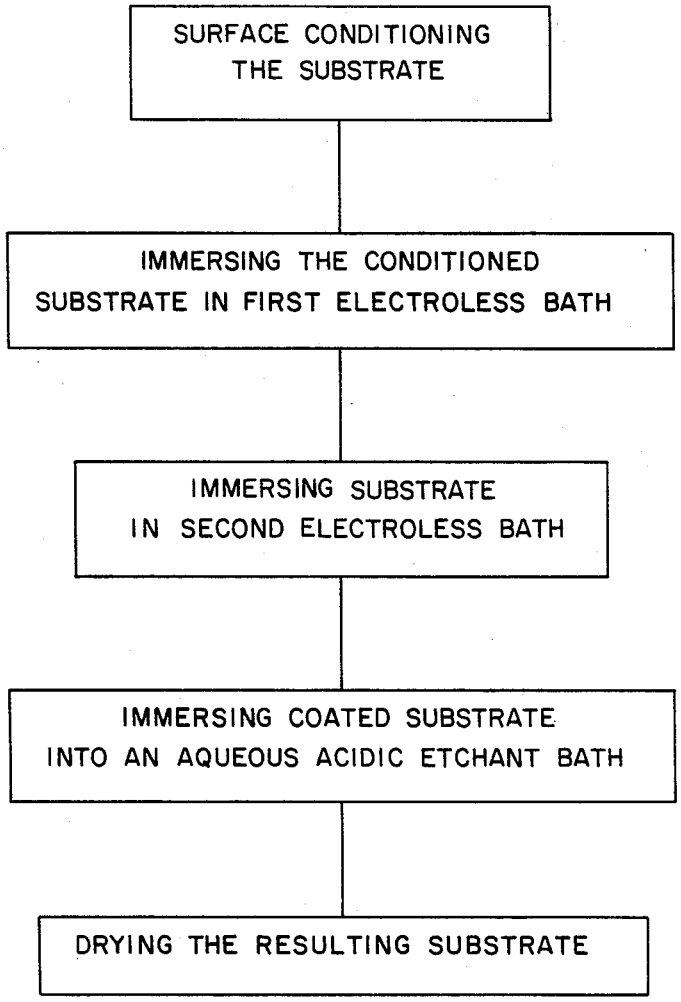
FIG. 1 is a flow chart showing the essential steps of the subject invention.

More specifically, the improved process of the present invention requires as an initial step, surface-conditioning the substrate so as to provide a roughened, non-smooth surface which ultimately is to be electrolessly plated.

The substrate can, of course, be one of a wide variety of materials which can have either catalytic or non-catalytic surfaces to be plated autocatalytically. Substrates having a catalytic surface to be treated in accordance with the present invention include, for instance, metallic substrates of iron, nickel, aluminum, titanium and the like. Substrates having an inherently non-catalytic surface include for instance ceramic, glass and plastic materials and are rendered catalytic by, for instance, treating them with a sensitizing agent such as stannous chloride and then treating them with an activating agent such as palladium chloride. Conventional one step or two step sensitizing and activating procedures can also be employed.

It is critical, however, regardless of the particular material selected as the substrate, to surface-condition it so that it has a roughened, non-smooth surface. Any conventional technique can be employed to roughen the substrate surface such as by chemical etching, by abrading the surface using, for instance, sand, or alumina grit blasting techniques, by anodizing the surface, or by a combination of one or more of these techniques.

When the substrate selected is, for instance, one having a catalytic surface, such as aluminum, the surface can be roughened by blasting the same with sand or alumina grit. Thereafter the roughened surface can be anodized and subsequently zincated, in accordance with conventional techniques. In anodizing the surface, the aluminum substrate material can be contacted with a dilute solution of an acid such as sulfuric or phosphoric acid wherein the acid is present in an amount of about 15 to 20 weight percent, at a temperature of about 48° to 52° F. using a voltage of about 12 to 16 volts for a period of time whereby the surface remains unsealed, and generally from about 30 to 45 minutes. Following anodizing, the surface roughness may be further enhanced by immersing the anodized material in an acidic solution, for example, a 20 percent solution of nitric acid for 6 to 8 minutes.

The anodized surface can then be zincated, again employing conventional techniques. For instance, the substrate can be immersed in a zinc solution at a temperature of about 70° F. for a period of time ranging from about 30 to 40 seconds, thoroughly rinsed, then immersed in about a 50% nitric acid solution at a temperature of about 70° F. and again thoroughly rinsed. If a second zincating operation is desired, the above procedures can be repeated although it has been found convenient to limit the time of the immersion operation to about 15 to 20 seconds. A third zincating operation can also be utilized with the time of immersion preferably being limited to about 10 to 12 seconds.

A typical zincating solution is one containing 70 oz/gal sodium hydroxide, 30 oz/gal zinc oxide, 0.13 oz/gal ferric chloride and 1.3 oz/gal Rochelle salts.

When the substrate selected is non-catalytic in nature, i.e. it is one, for instance, made of plastic, glass or ceramic, the surface of the substrate is initially roughened, for instance, by using conventional mechanical abrading or chemical etching techniques employing, for instance, such etchants as phosphoric acid, sulfuric acid, chromic acid or hydrochloric acid.

Thereafter, the roughened, non-catalytic surface can be rendered catalytic by conventional techniques. For instance, the surface can be treated with a sensitizing agent such as stannous chloride and then treated with an activating agent such as palladium chloride. A typical sensitizing solution is one containing about 0.1 to 0.5 g/l $SnCl_2$ and 0 to 2.0% by weight of a 35% aqueous solution of HCl, and having a pH of about 6.5 to 7.5. A typical activating solution is aqueous palladium chloride solution containing about 0.005 to 0.5 weight percent palladium chloride in the presence of HCl and having a pH of about 5. Alternatively, a conventional one-step procedure for rendering the non-catalytic surface catalytic can be employed. For instance, the non-catalytic surface can be treated with a colloidal solution prepared by introducing both palladium chloride and stannous chloride into a highly acidified aqueous solution, the solution being acidified with hydrochloric acid. The palladium ions are thus reduced within the solution to the zero valence state by the stannous ions.

Subsequent to surface-conditioning a catalytic substrate or to surface-conditioning and rendering catalytic a non-catalytic substrate, the substrate is generally rinsed thoroughly with, for instance, de-ionized water.

Thereafter, the substrate which has been surfaced-conditioned is immersed in a first electroless plating bath having a low phosphorus to nickel concentration to produce a first electroless nickel-phosphorus alloy coating on said substrate. Preferably the bath has a phosphorus content of about 4 to 5 weight percent. A suitable electroless plating bath for use as the initial plating bath is that described in British Pat. No. 830,597. Such a bath comprises an aqueous solution of hydrogen fluoride, a nickel salt other than nickel chloride or nickel sulfate, a compatible hypophosphite ion, an organic acid salt and, optionally, potassium or ammonium fluoride. The bath is employed at a pH between 3.5 and 7.0 preferably about 6.6 to 6.8 and at a temperature between 90° and 212° F. Immersion times can range from about 30 to 60 minutes or at least until the resulting coating has a thickness ranging from about 0.3 to 0.8 mils, preferably about 0.5 mils.

The main function of the surface conditioning in accordance with this invention is to render an uneven or nonsmooth surface topography that will, it is hypothesized, allow the effective foundation for subsequent macroscopic pore manifestation in the uppermost coating.

Conveniently this initial plating bath comprises 0.15 to 2.5 moles per liter of fluoride, 0.4 to 1.4 moles per liter of nickel obtained from soluble nickel salts other than nickel chloride or nickel sulfate, 0.4 to 2.6 moles per liter of hypophosphite, buffered to a pH between 3.5 and 7.0.

Preferably, the pH is maintained between 5.0 and 6.8, the pH control being accomplished by the addition of ammonium hydroxide, hydrogen fluoride, or other basic or acidic materials compatible with the bath. Conveniently a salt of an organic acid such as sodium citrate is employed as a buffer as well as chelating agent.

The presence of the fluoride ion is generally accomplished by the addition of an aqueous solution of hydrogen fluoride, although fluoride salts can also be employed such as alkali metal, ammonium or nickel fluorides.

While nickel carbonate is generally used to provide the nickel ion concentration, other soluble nickel salts can be employed such as nickel cyanide, nickel fluoride, nickel acid fluoride, nickel hydroxide, nickel oxalate, nickel oxide, nickel phosphide or nickel hypophosphite.

A water-soluble salt of a hypophosphite, for example, an alkali metal hypophopshite can be employed. Preferably sodium hypophosphite is used.

The thus coated substrate is removed from the first electroless plating bath water rinsed and then immersed in a second electroless plating bath having a phosphorus to nickel concentration higher than that of said first electroless plating bath so as to produce a second electroless nickel-phosphorus alloy which is directly superimposed on said first electroless nickel-phosphorus alloy coating. Preferably the second electroless plating bath has a phosphorus content of about 7 to 8 weight percent.

A number of such electroless plating baths can be used as the second electroless plating bath which comprise, generally a nickel salt, a hypophosphite, a complexing agent and an organic stabilizer such as thiourea. It has been found that certain metal ions may seriously jeopardize the plating operation if present, even in small concentrations. In this regard, any stabilizer used in accordance with this invention must be free of cadmium and lead. Thus, metallic stabilizers such as cadmium and lead are unsatisfactory. The bath is employed at a pH between 4.6 and 5.2, preferably between 4.9 and 5.1 and at a temperature between 185° and 195° F. Immersion times can range between 3 and 4 hours or at least until the resulting second coating has a thickness ranging from about 2.5 to 3.5 mils. A commercial bath which has been found suitable is Enplate NI-419 manufactured by Enthone, Inc., New Haven, Conn.

The nickel salt employed in this second electroless plating bath can be inorganic or organic water soluble nickel salts such as nickel chloride, nickel sulfate, nickel acetate, nickel bromide, nickel iodide or a mixture thereof and is present, generally, in an amount of about 0.089 to 0.128 moles per liter.

A water-soluble salt of hypophosphite, as used in the first electroless plating bath, can also be employed in this second electroless plating bath. Again, preferably, sodium hypophosphite is employed, in amounts generally ranging from about 0.170 to 0.250 moles per liter.

Conventional complexing agents such as an aliphatic carboxylic acid or a salt thereof, including, for instance, lactic acid, acetic acid or salts thereof can be employed. Generally the complexing agent is used in an amount ranging from about 0.300 to 0.400 moles per liter.

Known stabilizers can also be included in the second electroless plating bath including such stabilizers as propionic acid. The stabilizer can be present in conventional amounts and generally is employed in an amount ranging from about 1.0 to 5.0 ppm of bath solution.

The resulting coated substrate is then removed from the second electroless plating bath and rinsed, preferably with deionized water.

Thereafter this electroless nickel-phosphorus alloy coated substrate is immersed into an acidic etchant bath containing from about 0.1 to about 2.0 percent by weight divalent nickel, about 2 to 3 weight percent sulfuric acid and about 45 to 49 weight percent nitric acid for a period of time effective to develop a highly blackened surface.

The temperature of the acidic etchant bath is generally maintained at about 70°-90° F., preferably about 80° F. and the substrate is held immersed in this etchant bath for a period of time ranging from about 2 minutes to about 3 minutes, preferably about 2.5 minutes or at least until there are formed on the surface of the substrate a multiplicity of microscopic and macroscopic pores. Preferably the coverage of microscopic pores to macroscopic pores is about equal in area.

A useful aqueous acidic etchant bath comprises about 49 weight percent nitric acid (42° Be'), 49 weight percent deionized water and about 2 weight percent sulfuric acid (66° Be'), to which has been added 0.1 oz/gal nickel in the form of nickel nitrate.

On removal from the aqueous acidic etchant bath, the substrate is thoroughly rinsed and dried.

The substrate after drying is ready for service as an optical black for use, for example, in an electro-optical system. FIG. 1 depicts the entire process in accordance with the instant invention.

If desired, the resulting substrate having the highly blackened surface, characterized by a solar absorptivity ranging from about 0.978 to about 0.980 and a room temperature emissivity of at least 0.850 can be heated in an air oven at a temperature ranging from about 110° to 160° C. for a period of at least one hour and preferably for a period ranging from about 3 to 18 hours, to enhance the durability of the highly blackened coating applied to the substrate.

The following non-limiting examples are given to illustrate the invention.

EXAMPLE 1

Panels measuring 2×2 inches of 6061 aluminum were subjected to an anodizing process to roughen the surface thereof, using about 12 volts for about 45 minutes in about 18 percent sulfuric acid solution. Following anodizing and rinsing, the panels were immersed in a 20 percent (by volume) aqueous solution of nitric acid (42° Be') for 8 minutes. Microscopic examination of thus treated panels revealed roughened surfaces.

The resulting surface-roughened panels of the anodized/etched aluminum (unsealed) were then thoroughly rinsed and double zincated by immersion in a zincate solution containing 70 oz/gal sodium hydroxide, 30 oz/gal zinc oxide, 0.13 oz/gal ferric chloride and 1.3 oz/gal of Rochelle salts, at a temperature of about 70° F. The panels were then rinsed with deionized water for about 30 seconds and then immersed in about 50% aqueous nitric acid solution maintained at about 70° F. Thereafter the panels were rinsed, immersed again in a zincate solution, as defined above, for about 12 seconds and finally rinsed.

The resulting surface-conditioned panels were then immersed for a period of about 30 minutes in a first electroless plating bath comprising an aqueous solution of 1.3 oz/gal nickel carbonate, 0.2 oz/gal hydrofluoric acid, 0.7 oz/gal citric acid, 2 oz/gal ammonium bifluoride, 2.7 oz/gal sodium hypophosphite and 4 fluid oz/gal ammonium hydroxide. The bath was maintained between a temperature from about 140° to 158° F. with the pH of the bath being about 6.6 to 6.8. The resulting panels were thus provided with a dull, non-bright nickel-phosphorus alloy coating having a thickness between about 0.4 and 0.5 mil.

The thus-initially coated panels were then immersed for a period of about 3 to 4 hours in a second electroless plating bath comprising an aqueous solution of 4.5 oz/- gal nickel sulfate, 4.7 oz/gal sodium hypophosphite, 4.7 fluid oz/gal malic acid, 1.3 oz/gal succinic acid and about 1 ppm thiourea, the latter two components serving as a stabilizer for the bath. The bath was maintained between a temperature of about 180° to 190° F. with the pH of the bath being about 4.9 to 5.1. The resulting panels were thereby provided, directly superimposed over the first coating, with a second dull, non-bright metallic nickel-phosphorus alloy coating having a thickness between about 2.5 and 3.0 mils.

On removal from this second electroless plating bath, the panels were thoroughly rinsed and then immersed for a period of about 2.5 minutes in an aqueous etchant bath comprising about 49 weight percent nitric acid (42° Be'), 49 weight percent water, about 2 weight percent sulfuric acid (66° Be') to which was added 0.1 oz/gal nickel in the form of nickel nitrate. The temperature of the etchant bath was maintained between about 80° and 85° F.

On removal of the panels from the etchant bath they were thoroughly rinsed and dried. Analysis of the second coating composition revealed that the amount of phosphorus was about 8 weight percent and the amount of nickel was about 92 weight percent. The panels, tested by instrumentation, exhibited a solar absorptivity ranging from about 0.978 to about 0.980 and a room temperature emissivity of at least about 0.800. The absorptivity $\alpha_\epsilon$ measurements were made using a Gier-Dunkle Model MS-251 and the emissivity $\epsilon$ measurements were made using a Gier-Dunkle Model DB-100.

The coating comprises a multiplicity of amorphous or quasicrystalline nickel/phosphorous deposits that form more or less a discontinuous, porous array over the entire surface, each individual deposit having an essentially column-like structure.

EXAMPLE 2

For comparative purposes, using the system described in U.S. Pat. No. 4,233,107, a second group of panels measuring 2×2 inches and made of 6061 aluminum, were subjected to the electroless plating conditions set forth in this patent. The panels, of course, were not surface-conditioned, as required in the present invention, i.e. the surfaces were essentially smooth. The panels, after being treated to degrease the same and to remove surface oxides by immersion in a suitable acid dip, followed by being rinsed in either de-ionized or distilled water, were immersed in a single electroless plating bath containing 32 g/liter nickel sulfate, 50 g/l sodium hydroxyacetate, 3 g/l boric acid and 10 g/l sodium hypophosphite. The pH of the bath was maintained at 6.5 and the temperature at about 194° F. There was thus deposited on the panels a nickel phosphorus alloy coating have a thickness of about 2 mils.

The panels were removed from the electroless plating bath, washed and then dried. Thereafter they were immersed in an etchant bath consisting of an aqueous solution of nitric acid wherein the nitric acid concentration was about a 1:5 ratio with water to concentrated, until the substrate surface developed blackness. The blackness developed on the electroless nickel-phosphorus alloy coating in about 10 seconds.

Thereafter the panels were washed and dried and subjected to the absorptivity and emissivity measurements in essentially the same manner as were the panels produced in Example 1. The solar absorptivity was between about 0.980 and 0.985 while the room temperature emissivity was between about 0.400 and 0.500.

Figure 2:
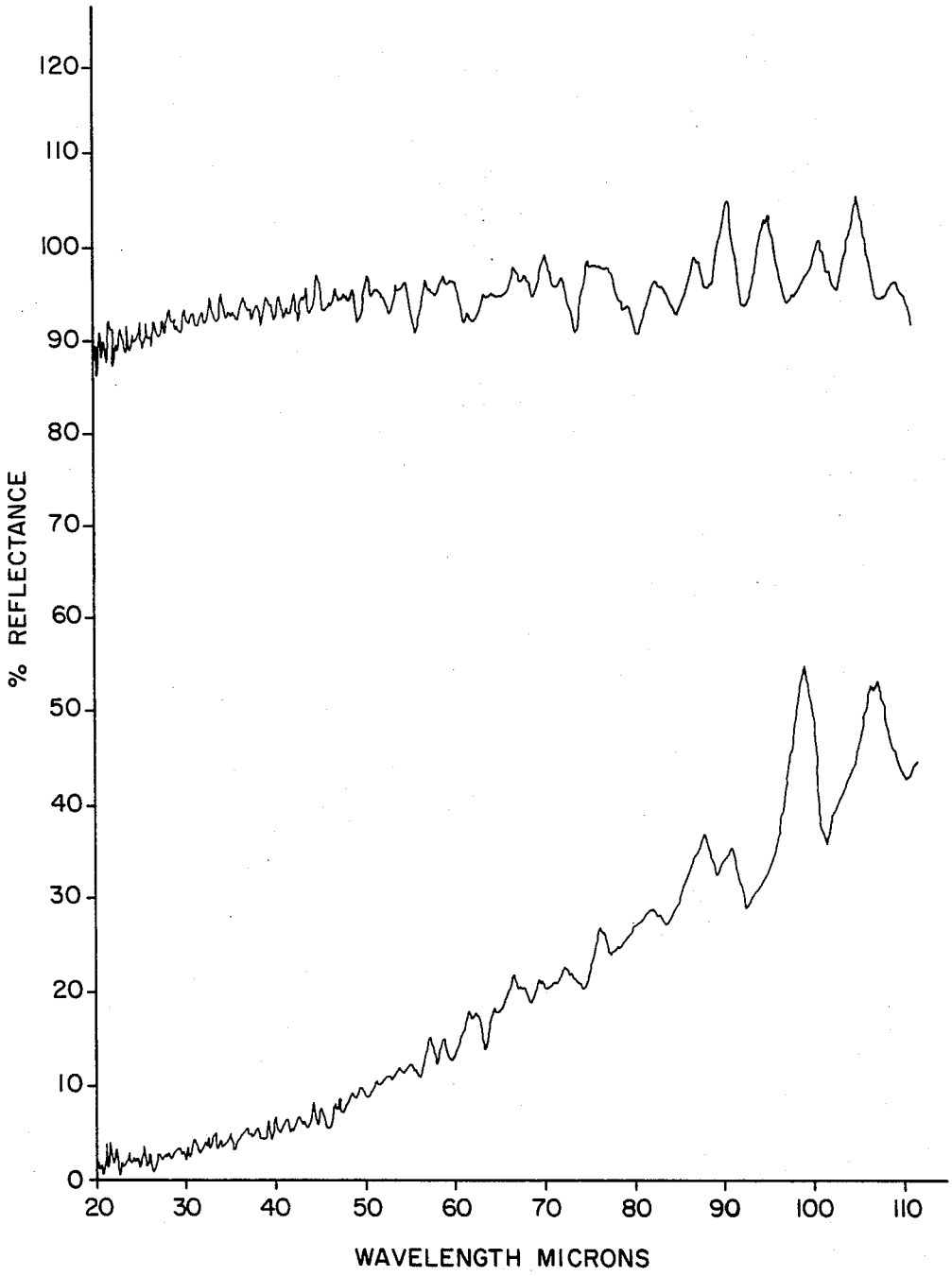
FIG. 2 is a graph of spectral reflectance versus wavelength.
Figure 3:
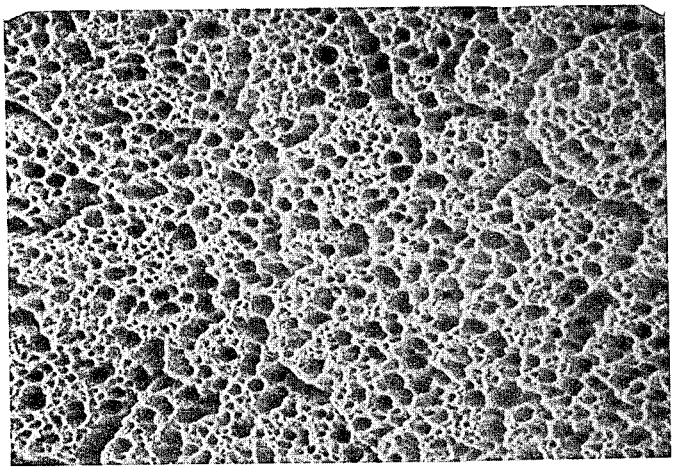
FIG. 3 is photomicrographs of the subject invention and the prior art taken 650× by a scanning electron microscope.
Figure 3:
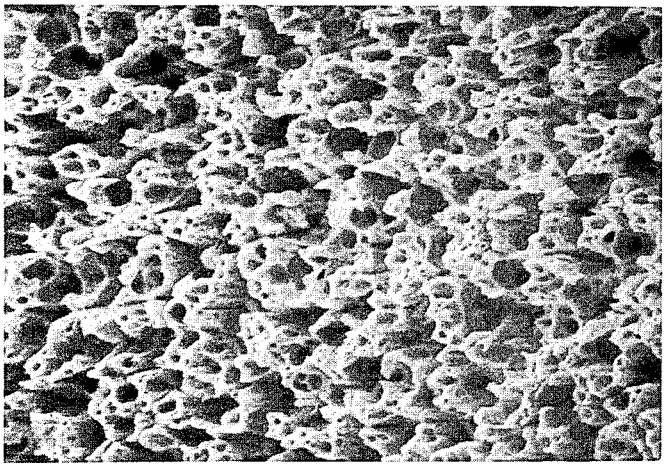

FIG. 2 shows a comparison between the subject invention (lower portion of graph) and the blackened panel from the prior art of Johnson, Sr., (upper portion of graph). FIG. 3 shows a comparison of the morphology of these panels at 650×, the upper one being that of Johnson, Sr., and the lower one being the subject invention.

Figure 4:
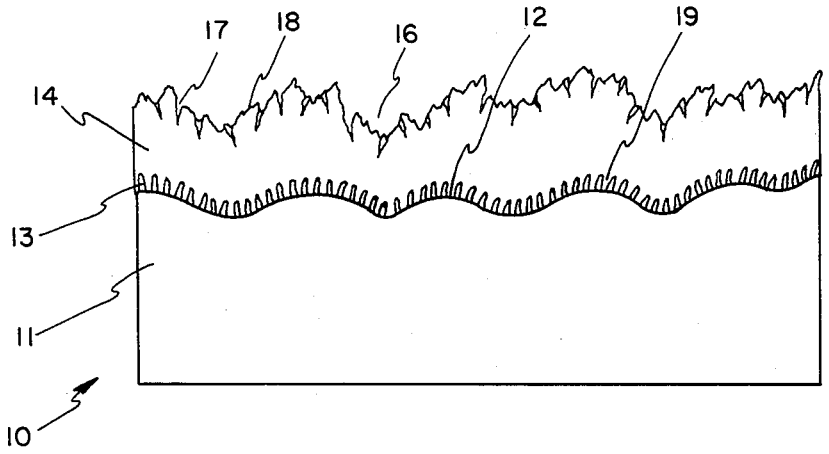
FIG. 4 is a schematic sectional view of an enlarged portion of a substrate having been treated in accordance with the subject invention.

FIG. 4 shows a schematic sectional view of a substrate 10 coated and treated in accordance with the instant invention. The substrate 10 comprises a base 11, a discontinuous alloy layer 13 joined to said base 11 and a continuous alloy layer 14 united to and overriding alloy layer 13. The substrate 1D includes a nonplanar surface 12 formed by the conditioning process disclosed herein. Surface 12 is provided as shown with a multiplicity of deposits 13 that are essentially dispersed and comprise the low nickel/phosphorus alloy. The deposit 13 is substantially a discontinuous layer and is formed by the initial or first electroless plating process. The deposit 13 is essentially an array of amorphous or quasicrystalline forms each form being spaced so as to provide voids 19 therebetween. Following the roughened contour of surface 12 is a continuous alloy layer 14 of a high nickel/phosphorus alloy, said alloy layer being formed by the second electroless plating process. It can be seen from FIG. 4 that the continuous alloy layer 14 presents an array of macroscopic pores 16, said pores being due essentially to the nonplanar surface 12. Moreover, etched into the exterior surface 18 are a dense array of microscopic pores 17. Thus, the surface 18 presents a full array of microscopic as well as macroscopic pores 17 and 16, respectively.

It is understood that several modifications to the above described invention may be made by those skilled in the art, and it is intended to cover all such modifications which fall within the scope and spirit of the appended claims.

What is claimed is:

1. A blackened substrate which comprises a substrate coated with at least two different nickel-phosphorus alloys, said substrate having a dense array of microscopic as well as macroscopic pores etched into the surface having a spectral reflectance of less than about 5 percent at wavelength of radiant energy from about 0.3 to about 40 microns wherein the lowermost alloy layer comprises about 95% to 96% nickel and about 4% to 5% phosphorus and the uppermost alloy coating contains 92% to 93% nickel and about 7% to 8% phosphorus.

2. The substrate of claim 1 where the microscopic pores have a size range less than 1 micron to 7 microns and the macroscopic pores have a size range of 7 microns to 25 microns.

3. The substrate of claim 1 wherein the surface of the uppermost alloy coating is nonplanar.

4. The substrate of claim 1 wherein the lowermost alloy layer is substantially discontinuous.

5. A method for producing a highly blackened surface, having high light absorption and high emissivity capabilities on a substrate, said method comprising (a) surface conditioning said substrate so as to provide a roughened, non-smooth surface, (b) immersing the thus surface-roughened substrate in a first electroless plating bath having a low phosphorus to nickel concentration wherein said first electroless plating bath has a phosphorus content of about 4 to 5 weight percent based on the total weight of said bath so as to deposit a first electroless nickel-phosphorus alloy coating on said surface-roughened substrate, (c) immersing said coated substrate from said (b) in a second electroless plating bath having a phosphorus to nickel concentration higher than that of said first electroless plating bath wherein said second electroless plating bath has a phosphorus content of about 7 to 8 weight percent based on the total weight of said bath so as to deposit a second electroless nickel-phosphorus alloy coating which is superimposed directly on said first electroless nickel-phosphorus alloy coating, (d) immersing the electroless nickel-phosphorus alloy coated substrate resulting from step (c) into an aqueous acidic etchant bath containing about 0.1 to about 2.0 weight percent divalent nickel, about 2 to 3 weight percent sulfuric acid and about 45 to 49 weight percent nitric acid for a period of time effective to develop a highly blankened surface of said substrate and (e) drying the resulting substrate having said highly blackened surface.

6. A substrate having a higly blackened surface exhibiting high light absorptivity and high emissivity capabilities made in accordance with the method of claim 5.

7. The method of claim 5 wherein said first electroless plating bath is maintained at a pH ranging from 3.5 to 7.0 and at a temperature ranging from 90° to 212° F.

8. The method of claim 5 wherein the second electroless nickel-phosphorus alloy coating has a thickness ranging from about 2.5 to 3.5 mils.

9. The method of claim 5 wherein said second electroless plating bath is maintained at a pH ranging from 4.8 to 5.2 and at a temperature ranging from about 175° to 190° F.

10. The method of claim 9 wherein said pH ranges from 4.9 to 5.1.

11. The method of claim 5 wherein said aqueous etchant bath, based on the total weight of said bath, contains from about 0.1 to 2.0 weight percent divalent nickel, from about 2 to 3 weight percent sulfuric acid and from about 45 to 49 weight percent nitric acid.

12. The method of claim 5 wherein the temperature of said aqueous etchant bath is maintained at about 75° to 85° F.

13. The method of claim 5 wherein the electroless nickel-phosphorus alloy coated substrate is immersed in said aqueous acidic etchant bath for a period of time ranging from about 2 to 3 minutes.

14. The method of claim 5 wherein said first electroless plating bath comprises 0.15 to 2.5 moles/liter fluoride, 0.4 to 1.4 moles/liter nickel obtained from a soluble nickel salt other than nickel chloride or nickel sulfate and 0.4 to 2.6 moles/liter hypophosphite, and wherein said bath has a pH ranging from about 5.0 to 6.8.

15. The method of claim 14 wherein said pH ranges from about 6.6 to 6.8.

16. The method of claim 5 wherein the first electroless nickel-phosphorus alloy coating has a thickness ranging from about 0.3 to 0.7 mil.

17. The method of claim 16 wherein said thickness is about 0.5 mil.

18. The method of claim 5 wherein the electroless nickel phosphorus alloy coated substrate is etched in said aqueous acidic etchant bath to the extent of forming a multiplicity of microscopic and macroscopic pores on the surface thereof.

19. The method of claim 18 wherein the coverage of microscopic pores to macroscopic pores is about equal in area.

* * * * *